US006425362B1

(12) United States Patent
Kanno

(10) Patent No.: US 6,425,362 B1
(45) Date of Patent: Jul. 30, 2002

(54) FUEL INJECTION CONTROL SYSTEM

(75) Inventor: Isao Kanno, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/696,056

(22) Filed: Oct. 25, 2000

(30) Foreign Application Priority Data

Oct. 26, 1999 (JP) ..... 11-304648

(51) Int. Cl.[7] ..... F02N 17/00
(52) U.S. Cl. ..... 123/179.16; 123/491
(58) Field of Search ..... 123/179.16, 198 DB, 123/491

(56) References Cited

U.S. PATENT DOCUMENTS

| | | | | |
|---|---|---|---|---|
| 4,131,098 A | | 12/1978 | Daniels et al. | |
| 4,230,066 A | | 10/1980 | Lents | |
| 4,364,343 A | * | 12/1982 | Malik | 123/198 DB |
| 4,391,241 A | | 7/1983 | Dohshita et al. | |
| 4,515,131 A | | 5/1985 | Suzuki et al. | |
| 4,656,993 A | | 4/1987 | Yuzawa et al. | |
| 4,867,115 A | | 9/1989 | Henein | |
| 4,924,827 A | | 5/1990 | Minegishi | |
| 4,987,871 A | | 1/1991 | Nishikawa | |
| 4,998,521 A | | 3/1991 | Inone et al. | |
| 5,073,133 A | | 12/1991 | Inoue | |
| 5,074,263 A | | 12/1991 | Emerson | |
| 5,088,465 A | | 2/1992 | DeBiasi et al. | |
| 5,282,447 A | | 2/1994 | Kubota | |
| 5,535,135 A | | 7/1996 | Bush et al. | |
| 5,615,645 A | * | 4/1997 | Kanno | 123/198 DB |
| 5,713,334 A | | 2/1998 | Anamoto | |
| 5,870,986 A | | 2/1999 | Ichinose | |
| 5,878,726 A | | 3/1999 | Takahashi et al. | |

* cited by examiner

*Primary Examiner*—Noah P. Kamen
(74) *Attorney, Agent, or Firm*—Knobbe, Martens, Olson & Bear, LLP

(57) ABSTRACT

An internal combustion engine includes at least one combustion chamber formed by at least a first member and a second member that moves relative to the first member. The second member is coupled to an output shaft such that movement of the second member causes the output shaft to rotate. A fuel injection system includes a fuel injector that supplies fuel to the combustion chamber and a fuel pump that supplies fuel to the fuel injector. The fuel injector includes an actuator to regulate an amount of fuel injected by the fuel injector. A main switch has an on position and an off position. A fuel control system includes a controller, which is operatively connected to the actuator, and a sensor, which is arranged to detect rotation of the output shaft. The sensor is adapted to produce a signal that is indicative of rotation of the output shaft and is operatively connected to the controller. The controller is configured such that, when the engine is operating and the main switch is turned from the on position to the off position, the controller outputs a control signal to the actuator so that fuel is no longer injected through the fuel injector. After a specified time, the controller outputs a control signal to the actuator to inject a second amount of fuel when the sensor indicates that the output shaft is rotating below a specified speed.

15 Claims, 8 Drawing Sheets

FUEL INJECTION CONTROL SYSTEM

PRIORITY INFORMATION

This application is based on and claims priority to Japanese Patent Application No. 11-304,648 filed Oct. 26, 1999, the entire contents of which are hereby expressly incorporated by reference.

BACKGROUND OF THE INVENTION

1. Field of the Invention

This invention relates to fuel injection control systems for engines, and more particularly to fuel injection control systems that are suitable for outboard motors.

2. Related Art

Outboard motors are used to power boats and other watercraft. Outboard motors typically include an internal combustion engine that is surrounded by a protective cowling. In order to improve performance, and in particular fuel efficiency and emissions, many outboard motors use a fuel injection system to supply fuel to the engine. Fuel injection systems often include fuel injectors that inject fuel directly into an air induction device. The amount of fuel injected through the fuel injectors is determined by a control system, which usually includes an electronic control unit (ECU). Typically, the ECU determines the desired amount of fuel and the corresponding fuel/air ratio based upon the engine speed and load. The fuel injection system, therefore, can improve performance by precisely controlling the fuel/air ratio for each cycle of the engine over a wide variety of engine running conditions.

In general, the engine of an outboard motor is started by turning the crankshaft manually or with a started motor. When the engine is being started, engine speed cannot be determined until the engine completes one or more revolutions. Accordingly, during starting, fuel injection systems typically do not deliver fuel to the fuel injectors immediately. This prevents the engine from operating immediately upon starting and requires the crankshaft to be turned longer. However, because outboard motors often are operated under harsh conditions, it is desirable that they start quickly. Moreover, during starting, a battery often provides the power to turn the crankshaft. Thus, having to turn the crankshaft longer tends to drain the battery.

SUMMARY OF THE INVENTION

Accordingly, there is a need for a for an improved fuel injection control system that enables the engine to start more quickly.

One aspect of the present invention involves an internal combustion engine that includes at least one combustion chamber formed by at least a first member and a second member that moves relative to the first member. The second member is coupled to an output shaft such that movement of the second member causes the output shaft to rotate. A fuel injection system includes a fuel injector that supplies fuel to the combustion chamber and a fuel pump that supplies fuel to the fuel injector. The fuel injector includes an actuator to regulate an amount of fuel injected by the fuel injector. A main switch has an on position and an off position. A fuel control system includes a controller. which is operatively connected to the actuator, and a sensor, which is arranged to detect rotation of the output shaft. The sensor is adapted to produce a signal that is indicative of rotation of the output shaft and is operatively connected to the controller. The controller is configured such that, when the engine is operating and the main switch is turned from the on position to the off position, the controller outputs a control signal to the actuator so that fuel is no longer injected through the fuel injector. After a specified time, the controller outputs a control signal to the actuator to inject a second amount of fuel when the sensor indicates that the output shaft is rotating below a specified speed.

Another aspect of the present invention involves a method of stopping an internal combustion engine. The engine includes a combustion chamber, a crankshaft, a main switch, a fuel pump, and a fuel injector. The main switch is turned off and the fuel injection through the fuel injector is stopped. A rotational speed of the crankshaft is sensed. If the rotational speed of the crankshaft is below a specified value, an amount of fuel is injected through the fuel injector after the specified time.

Yet another aspect of the present invention involves an internal combustion engine comprising at least one combustion chamber that is formed by at least a first member and a second member that moves relative to the first member. The second member is coupled to an output shaft such that movement of the second member causes the output shaft to rotate. A fuel injection system includes a fuel injector that supplies fuel to the combustion chamber and a fuel pump that supplies fuel to the fuel injector. The engine further including means for providing fuel to the combustion chamber before the crankshaft begins rotation.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENTS OF THE INVENTION

FIGS. 1–4 illustrate an outboard motor 10 for powering a watercraft 12. The outboard motor 20 advantageously has a control system 11 (see FIG. 4) arranged and configured in accordance with certain features, aspects, and advantages of the present invention. The control system 11 of the present invention may also find utility in other applications that require the engine to start quickly. Such applications might include, without limitation, personal watercraft, small jet boats, and offroad vehicles.

Figure 1:
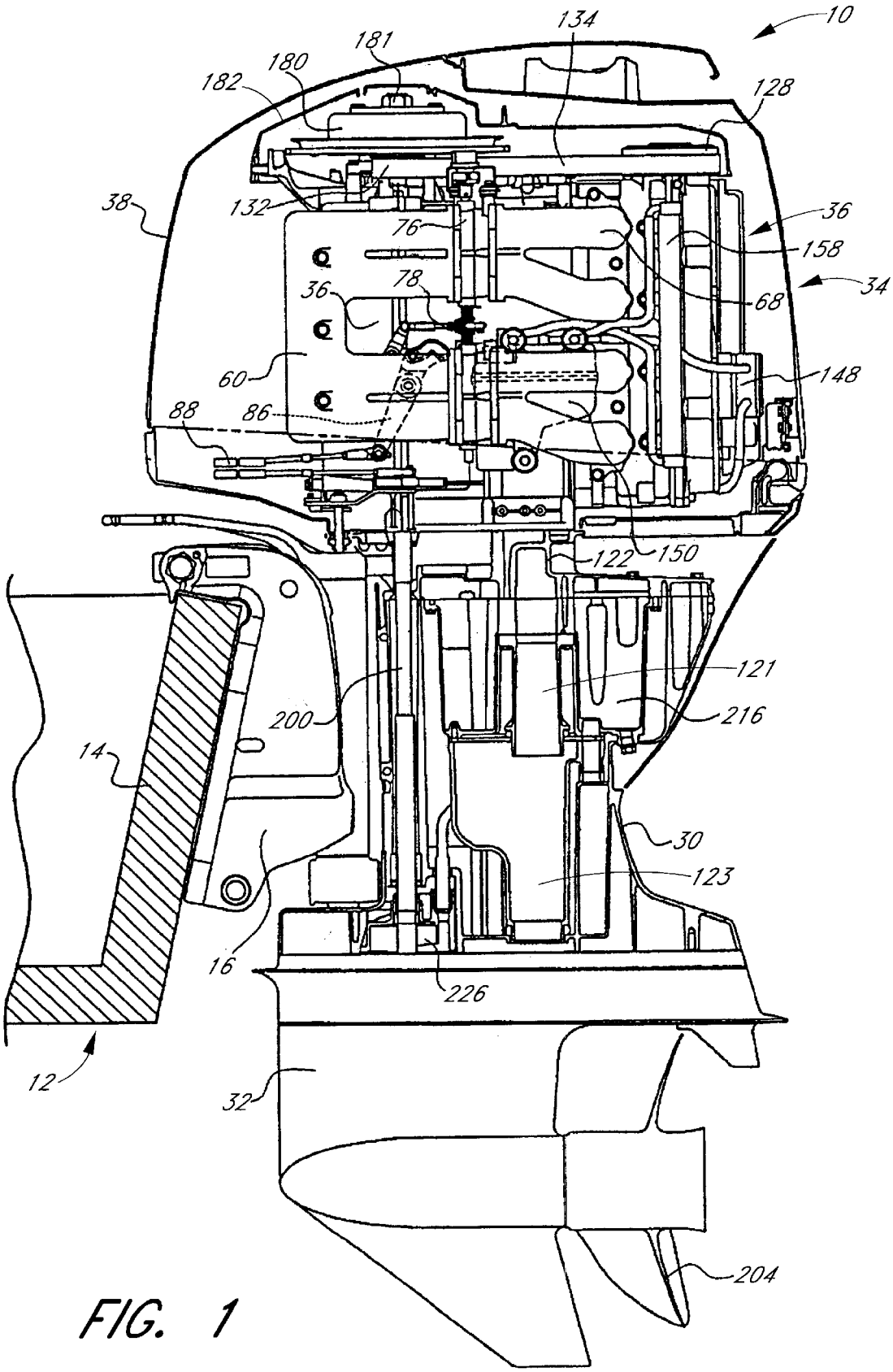
FIG. 1 is a partially cross-sectioned, side elevational view of an outboard motor including an internal combustion engine having certain features and advantages according to the present invention.

With initial reference to FIG. 1, the outboard motor 10 is attached to a transom 14 of the watercraft 12 through the use of a mounting bracket 16. Any suitable mounting bracket 16 can be used to attach the outboard motor 10 to the watercraft 12. The mounting bracket 16 preferably allows the outboard motor 10 to be tilted and trimmed about a generally horizontal axis and preferably allows the outboard motor 10 to be steered about a generally vertical axis. Such arrangements are well known to those of ordinary skill in the art. Throughout this description, the terms "forward," "front" and "fore" mean at or to the side of the mounting bracket 16. Correspondingly, the terms "rear," "reverse" and "rearwardly" mean at or to the opposite side of the front side, unless indicated otherwise.

The outboard motor 10 in the illustrated arrangement generally comprises a drive shaft housing 30 and a lower unit 32. A power head 34 is positioned above and is supported by the drive shaft housing 30. The power head 34 generally comprises a protective cowling 38 that encases an engine 36 and provides a protective environment in which the engine 36 can operate.

The illustrated engine 36 is of the four-cycle, in-line type. However, it should be noted that the present invention may find utility with other types of engines (e.g., v-type, opposed) with different numbers of cylinders and/or engines that operate under other principles of operation (e.g., two-cycle, rotary, or diesel principles).

Figure 2:
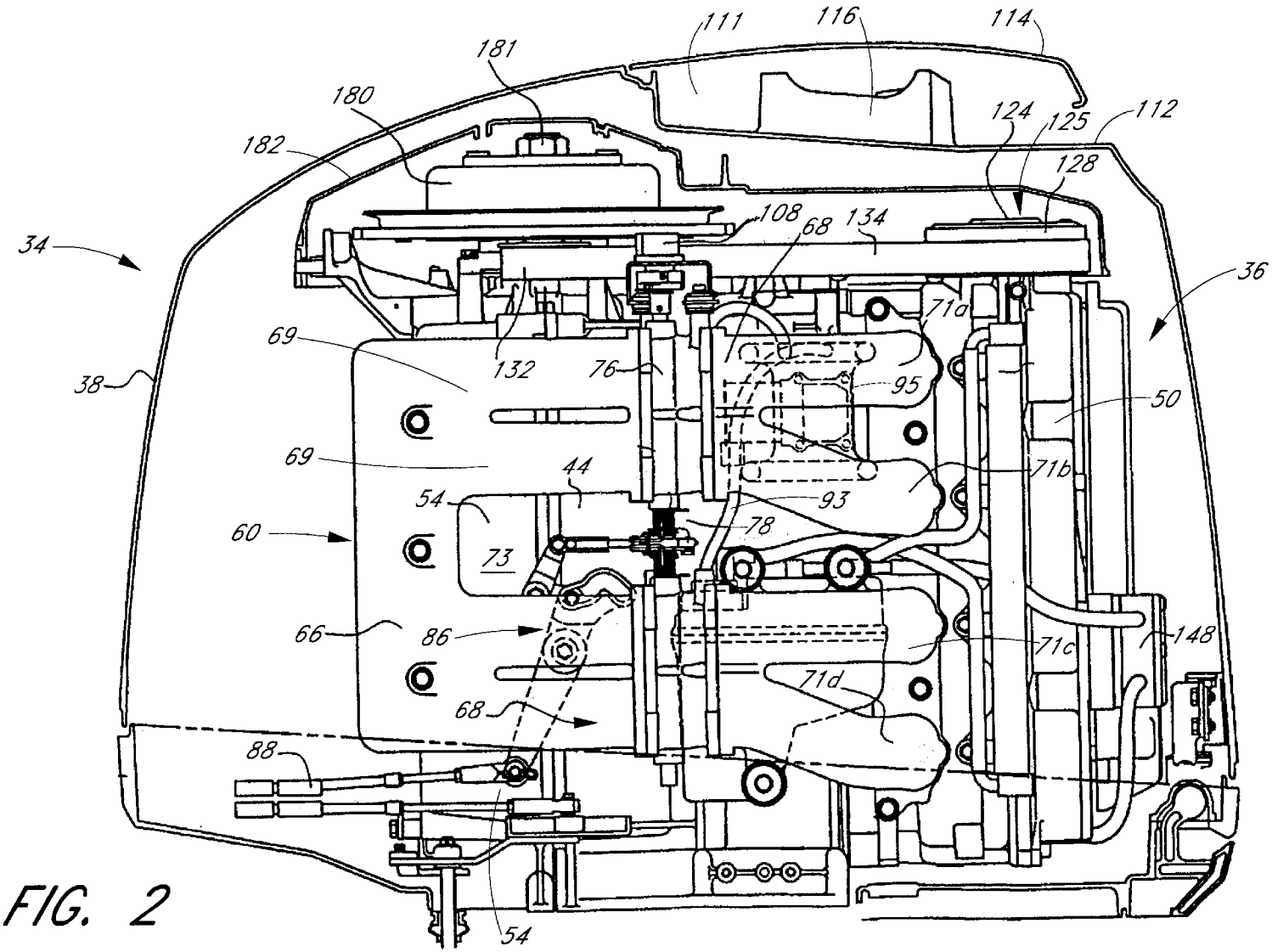
FIG. 2 is a side elevational view of a power head of the outboard motor of FIG. 1.
Figure 3:
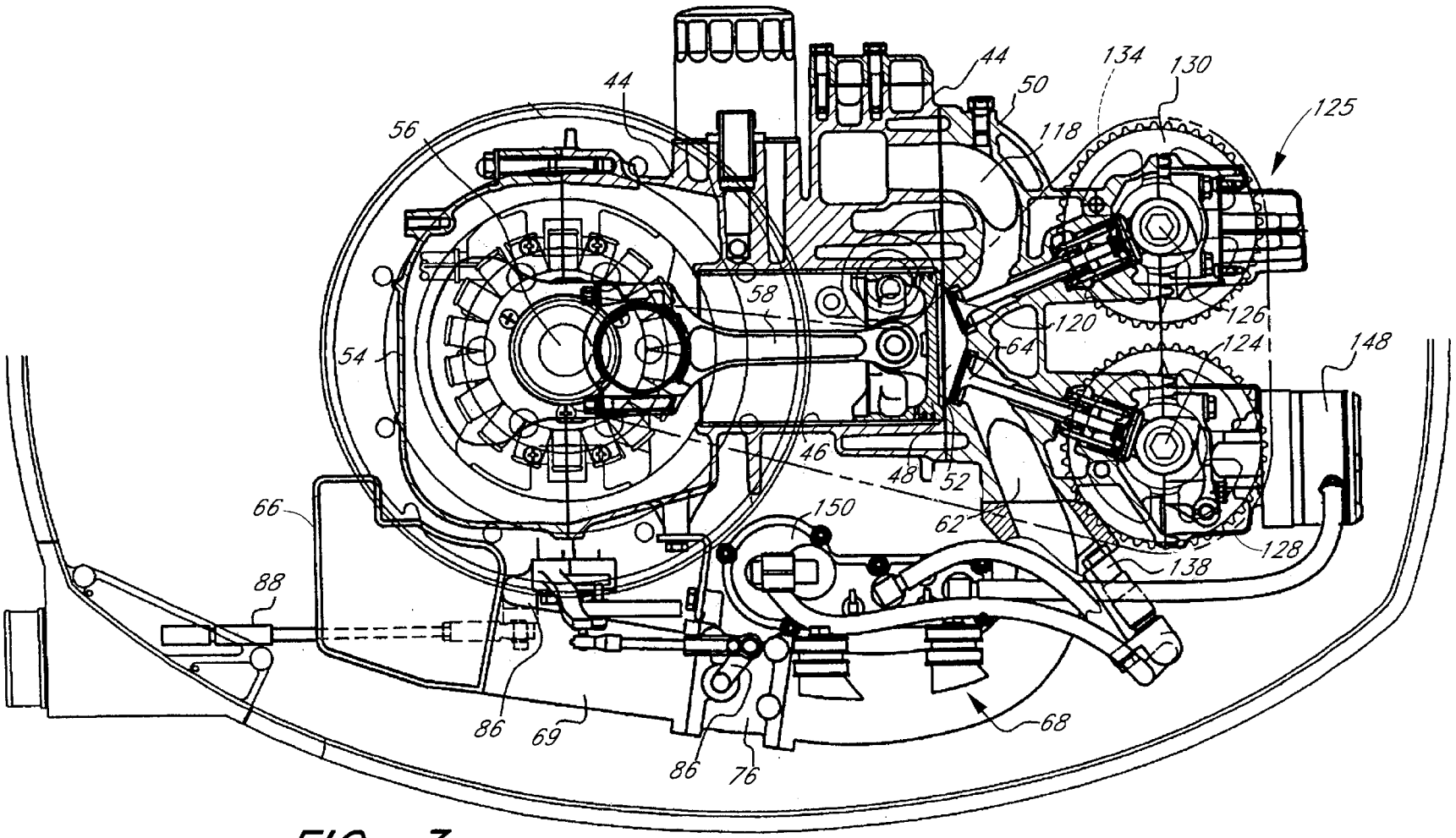
FIG. 3 is a partially cross-sectioned top wire frame view of the power head of FIG. 2 wherein a cylinder of the engine is cross-sectioned at a plane that includes an intake and an exhaust passage and an intake box is cross-sectioned at a plane that is located at approximately the vertical centerline of the intake box.

With particular reference to FIGS. 2 and 3, the illustrated engine 36 preferably comprises a cylinder block 44 in which four cylinder bores 46 are defined. It is anticipated that the cylinder block 44 can be replaced by individual cylinder bodies that define cylinder bores 46. In addition, the cylinder bores 46 may receive a sleeve or other suitable treatment to reduce friction between the cylinder block 44 and a piston 48, which is arranged for reciprocation within the cylinder bore 46.

A cylinder head assembly 50 preferably is positioned atop the cylinder block 44. The cylinder head assembly 50, in combination with the pistons 48 and the cylinder bores 46, defines four combustion chambers 52. The other end of the cylinder block 44 is closed with a crankcase member 54, which defines a crankcase chamber.

A crankshaft 56 extends generally vertically through the crankcase chamber. The crankshaft 56 is connected to the pistons 48 by connecting rods 58. Accordingly, the crankshaft 56 rotates with the reciprocal movement of the pistons 48 within the cylinder bores 46. In the illustrated engine 36, the crankcase member 54 is located at the forward most position of the power head 30, and the cylinder block 44 and the cylinder head assembly 50 extend rearwardly from the crankcase member 54.

Figure 5:
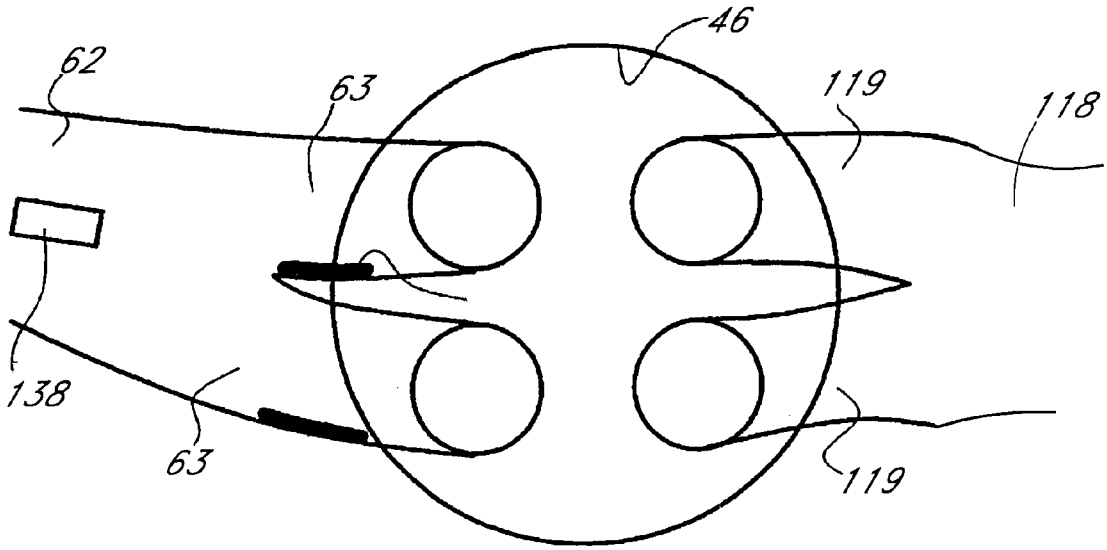
FIG. 5 is a schematic illustration of the intake passages and the exhaust passages.

The engine 36 includes an air induction system 60, which supplies an air charge to the combustion chambers 52. The illustrated induction system 60 includes intake passages 62, which are defined through a portion of the cylinder head assembly 50. As shown in FIG. 5, in the illustrated air induction system 60, the intake passages 62 preferably include two intake ports 63 that are disposed in the cylinder head 50 and communicate with the combustion chamber 52. Intake control valves 64 can be designed to control the flow of intake air through the intake ports 63 into the combustion chamber 52. The movement and control of the intake valves 64 will be described in detail below.

With particular reference to FIG. 2, the cowling 38 generally completely encloses the engine 36. Preferably, the cowling 38 includes an air intake compartment 111 that is defined between a top surface 112 of the cowling 38 and a cover member 114. The air intake compartment 111 has an air inlet duct 116 that connects the space in the compartment 111 and the interior of the cowling 38. In operation, air is introduced into the air intake compartments and enters the interior of the cowling 38 through the air inlet ducts 116.

With continued reference to FIGS. 2 and 3, air is drawn into the induction system 60 from the interior of the cowling 38 through an air intake box 66. In the illustrated arrangement, the air intake box 66 preferably is positioned on the port side of the crankcase member 54. The air intake box 66 preferably has an inlet opening (not shown) at its front side that opens to the interior of the cowling 38. The air drawn into the air intake box 66 is passed to the combustion chamber 52 via a set of intake pipes 68. The intake pipes 68 extend between the air box 66 and the associated intake passages 62 for each individual combustion chamber 52. As best seen in FIG. 2, in the illustrated arrangement, the fore portions 69 of the intake pipes 68 are formed integrally with the intake box 66. The aft portions 71*a–d* of the intake pipes 68 extend generally horizontally and parallel to each other. Moreover, the upper two intake pipes 68 preferably are arranged such that they lie generally closer to each other as compared to the lower two intake pipes. This arrangement creates a space 73 between the second and third intake pipes 68. In the illustrated arrangement, the aft portions 71*b*, 71*d* of the second and third intake pipes 68 also are slanted downward toward the intake ports 63, for reasons that will become apparent.

Figure 6:
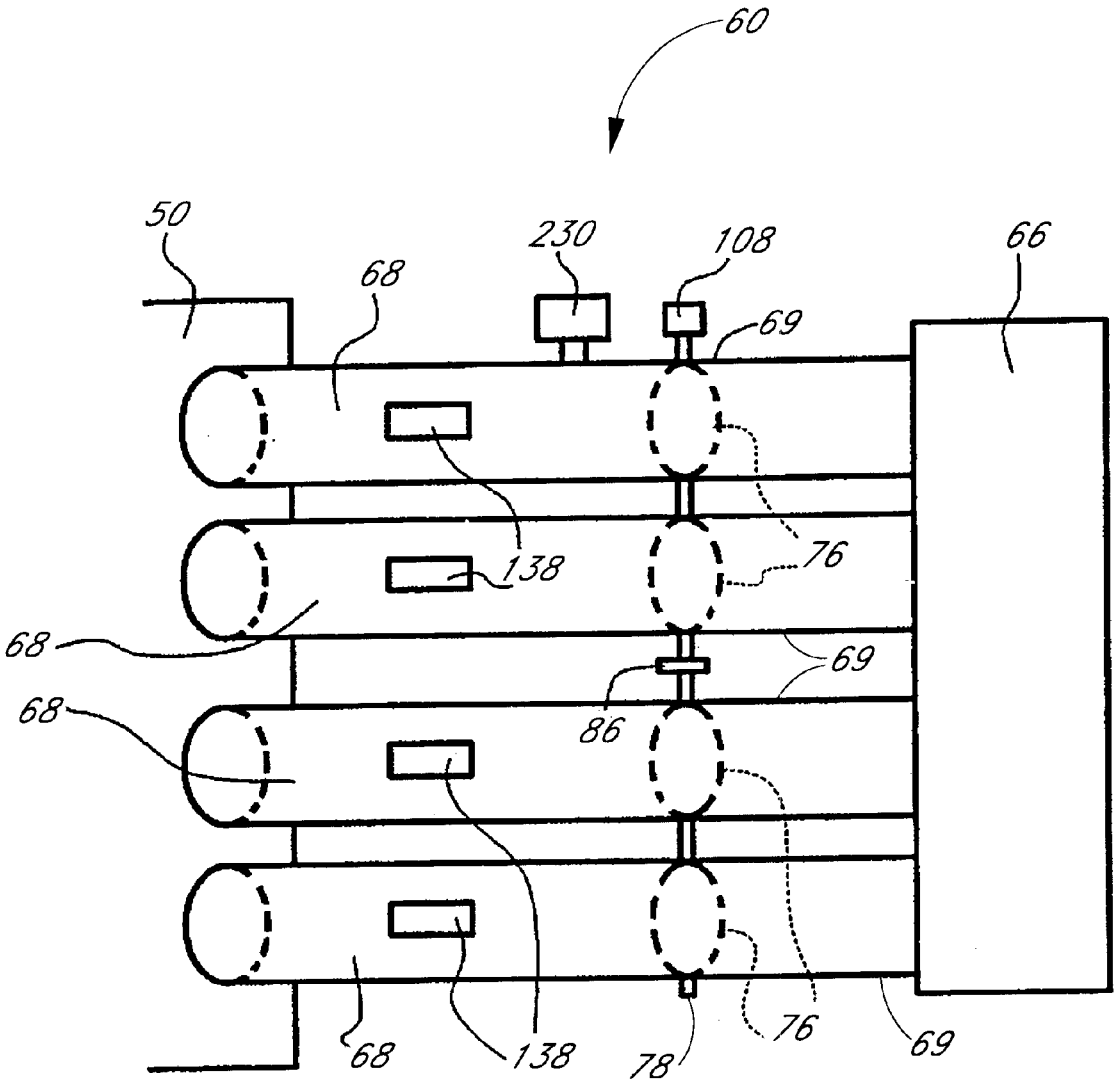
FIG. 6 is a schematic illustration of an induction system.

Flow through the intake pipes 68 is controlled through the use of throttle valves 76 (see also FIG. 6). In the illustrated arrangement, the throttle valves 76 are positioned on a single rod 78 and are controlled by a single control mechanism 86. The control mechanism 86 controls the movement of the valves 76 about a rotational axis in response to changes in operator demand. The control mechanism 86 is operated by the operator through a throttle cable 88, which is, in turn, connected to an accelerator pedal and/or an accelerator lever in any manner well known to those of skill in the art. Of course, flow through the intake pipes 68 can be controlled by throttle valves that are separately controlled or by a single throttle valve that controls the flow through the entire induction system.

Figure 4:
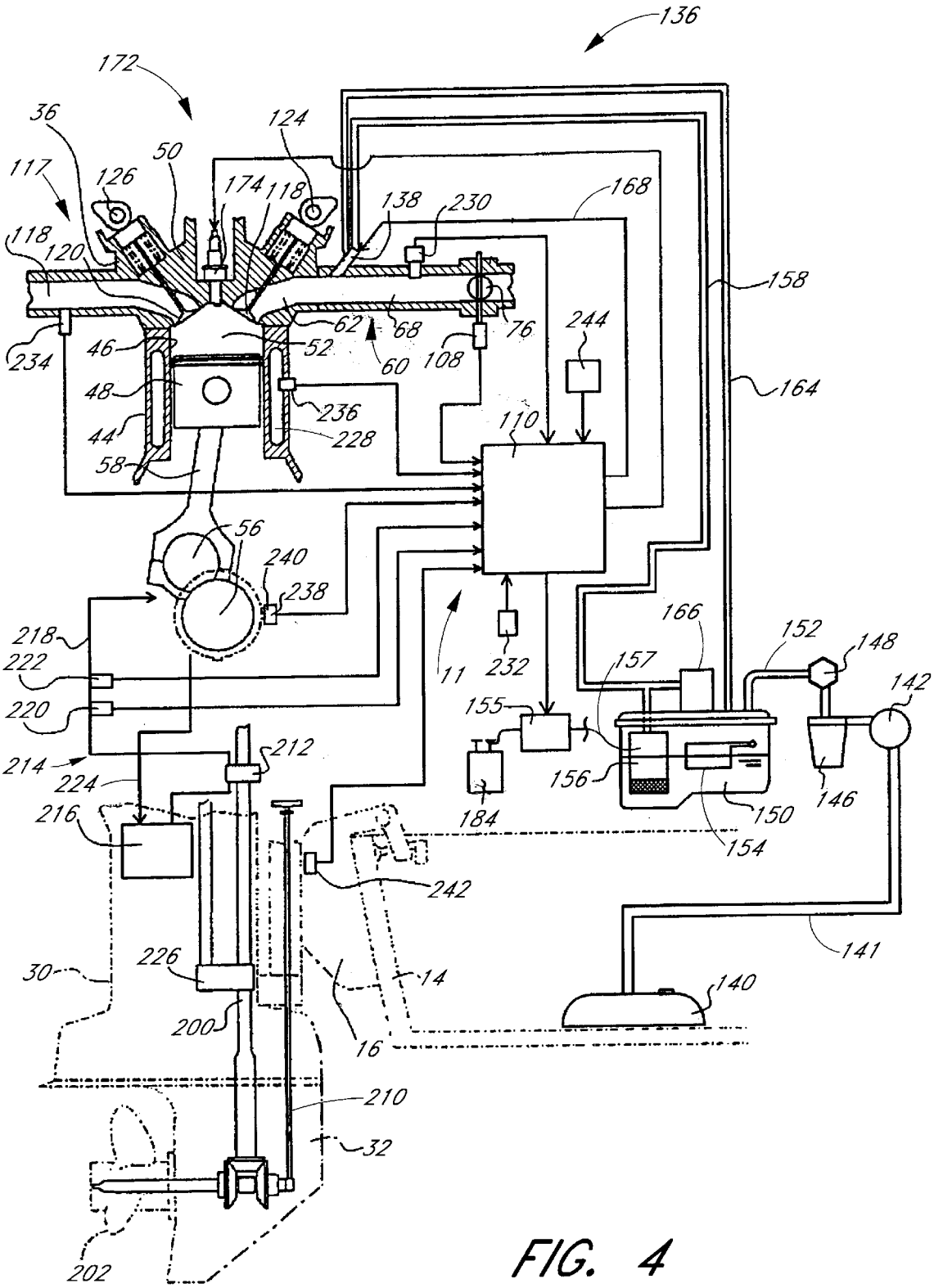
FIG. 4 is a schematic illustration of the engine of FIG. 1 including a control system that is arranged and configured in accordance with certain features, aspects and advantages of the present invention.

A throttle valve position sensor 108 preferably is arranged on top of the single rod 78. As shown in FIG. 4, the position sensor 108 preferably is connected to an ECU 110 to provide a signal to the ECU 110 that is indicative of a position of the intake valves 76. In the illustrated arrangement, the throttle valve position sensor is hardwired to the ECU 110. And, it is anticipated that any number of quick disconnect electrical couplings can be provided between the sensor 108 and the ECU 110. In addition, it is anticipated that the connection between the sensor 108 and the ECU 110 can have any suitable configuration. For instance, but without limitation, the two components can be connected by a physical wire, by infrared signals, by radio waves or any other suitable manner. Other sensors will be described below and such interconnections can be used with any of these sensors and the ECU 110. Moreover, the ECU 110 preferably also is designed to control various valves, injectors and injection systems through the use of a variety of control signals. The control signals can be sent between the ECU 110 and the receptor controlled component in any of the above-described manners as well. It should also be noted that the position sensor 108 and the ECU 110 are preferably part of the engine control system 11 which controls various aspects of engine operation and will be described in more detail below.

The engine 36 also includes exhaust system 117 that is configured to discharge burnt charges or exhaust gasses outside of the outboard motor 10 from the combustion chambers 52. The exhaust gases can be removed from the combustion chamber through exhaust passages 118 that are formed in the cylinder head assembly 50. As shown in FIG. 5, each exhaust passage 118 preferably includes at least two exhaust ports 119 that are disposed in the cylinder head 44 and communicate with the combustion chamber 52. Exhaust valves 120 preferably control the opening and closing of the exhaust ports 119.

With reference to FIG. 1, the illustrated exhaust system 117 preferably further comprises an exhaust conduit or manifold 121 that is in communication with the exhaust passages 118 and is partly formed by an exhaust guide 122, which is located under the engine 36 and partly formed in the drive shaft housing 34. The exhaust conduit 121 communicates with an exhaust expansion chamber 123, which is located below the exhaust guide 122 in the drive shaft housing 34. Accordingly, the exhaust gases can flow through the exhaust passages 118, the exhaust conduit 121 and then the exhaust expansion chamber 123. From the expansion chamber 123, a passage (not shown) preferably leads the exhaust gases from the expansion chamber 123 through the drive shaft housing 34 into the lower unit 32 such that the exhaust gases can be discharged into the body of water in which the watercraft operates in any suitable manner.

As best seen in FIG. 3, in the illustrated arrangement, an intake camshaft 124 and an exhaust camshaft 126 preferably are provided to control the opening and closing of the intake valves 64 and exhaust valves 120, respectively. The camshafts 124, 126 extend approximately vertically and parallel with each other. The camshafts 124, 126 have cam lobes that act against the valves 64, 120, at predetermined timings to open and close the respective ports. The camshafts 124, 126 are journaled on the cylinder head assembly 50 and are driven by the crankshaft 56 via a camshaft drive unit 125. In the illustrated embodiment, the camshaft drive unit 125 is positioned at the upper end of the engine 36, as viewed in FIG. 2. The cam shaft dive unit 125 comprises sprockets 128, 130 that are mounted to an upper end of the camshafts 124, 126. A sprocket 132 is mounted to the upper end of the crankshaft 56. A timing belt or chain 134 is wound around the sprockets 128, 130. Accordingly, as the crankshaft 56 rotates, the camshafts 124, 126 are driven.

Air inducted through the induction system 60 is mixed with fuel provided through a fuel injection system 136 (see FIGS. 3, 4 and 5). In the illustrated arrangement, the fuel injection system 136 includes four fuel injectors 138, which have injection nozzles exposed to the interior of the intake pipes 68, preferably downstream of the throttle valves 76. Accordingly, the illustrated arrangement is designed for indirect injection (i.e., fuel is injected into the induction system 60 at a location outside of the combustion chamber 52). In some arrangements, however, the fuel injectors 138 may be disposed for injection directly into the combustion chamber 52.

Fuel is supplied to the fuel injectors 138 from a main fuel supply tank 140, which, in the illustrated arrangement, is positioned within the associated watercraft 12. The fuel is drawn from the fuel tank 140 through a supply line 141 with a first low pressure pump 142. In some arrangements, the low pressure fuel pump 142 may be driven by pressure variations within the crankcase. The fuel is drawn by the fuel pump 142 and supplied to a fuel filter 146 in manners well known to those of ordinary skill in the art. In addition, fuel from the fuel filter 146 is drawn by a second low pressure pump 148 for deposit into a vapor separator 150 through a second fuel supply conduit 152. The vapor separator 150 preferably includes a float 154 that controls the level of fuel within the vapor separator 150 at any given moment.

A fuel pump 156 is provided within the vapor separator 150 to provide fuel from the vapor separator 150 to the fuel injectors 138 through a fuel supply line 158. In the illustrated arrangement, excess fuel that is not injected by the injector 138 returns to the vapor separator 150 through the return conduit 164. A pressure regulator 166 preferably is provided to limit the pressure of the fuel delivered to the fuel injectors 138. The fuel pump 156 preferably is controlled by the ECU 110 through a main relay 155 by a control signal 157 (see FIG. 4).

In operation, a predetermined amount of fuel is sprayed into the intake passages 68 via the injection nozzles of the fuel injectors 138. Since the fuel pressure is regulated by the pressure regulator 166, the amount of fuel injected into the combustion chamber 52 is determined in part by the duration in which the nozzles of the injectors 138 are opened. Preferably, the fuel injectors 138 are opened and closed by solenoids (not shown), as is known in the art. The solenoids can be controlled by the ECU 110. This is represented by a fuel control line 168 in FIG. 4. A fuel control system, which will be described in more detail below, directs the opening and closing of the fuel injectors 138.

The air fuel mixture drawn into the combustion chamber 58 can be ignited through the use of any suitable ignition system 172. In the illustrated arrangement, spark plugs 174 are disposed with an electrode positioned within the combustion chamber 52. The spark plugs 174 can be fired in accordance with any suitable ignition strategy and, in the illustrated arrangement, are controlled by the ECU 110.

As seen in FIGS. 1 and 2, a flywheel assembly 180 is affixed with a nut 181 to an upper end of the crankshaft 56. A cover member 182 covers the flywheel assembly 180, sprockets 128, 130, 132, and the belt 134 so as to prevent debris and/or other foreign materials from becoming entrained in the sprockets 128, 130, 132 and to protect an operator from the moving components when the upper cowling 38 is removed. The flywheel assembly 180 includes an AC generator that generates electric power. The generated AC power is led to a battery 184 through a rectifier that rectifies the AC power to DC power. The battery 184 accumulates electrical energy therein and also supplies it to electrical equipment including the ECU 110.

Although not illustrated, the outboard motor 10 preferably includes a starter motor and/or a recoil starter for starting the engine 36. The use of a starter motor is preferred when the present invention is employed with larger size engines. In such an arrangement, an operator activates the starter motor by a starter switch (not shown) or a main switch 244 that is preferably located in the watercraft 12.

As best seen in FIGS. 1 and 4, rotational power from the crankshaft 56 preferably is provided to a driveshaft 200, which is supported in the driveshaft housing 30. The drive shaft 200 is used to power an output device such as a propeller 202. In the illustrated arrangement, a forward-neutral-reverse bevel gear transmission 204 is interposed between the driveshaft 200 and a propeller shaft 206. The propeller shaft 206 is splined or otherwise suitably connected to the propeller 204. Movement of the propeller 204 also can be controlled by the transmission 204 in any other suitable manner.

In the illustrated arrangement, a shift rod 210 is provided to shift the transmission 204 between forward, neutral and reverse. Preferably, a position sensor (not shown) is provided to emit a signal to the ECU 110 that indicates a relative position of the transmission 204. For instance, the signal may indicate that the transmission is in a forward position, a reverse position or a neutral position. In some configurations, the signal may indicate that the transmission is either engaged or disengaged. In other words, the signal may indicate that the transmission is in a forward or reverse state or, alternatively, that the transmission is disengaged and in a neutral state.

Several other components also can be driven by the driveshaft 200. For example, in the illustrated arrangement, a lubricant pump 212 is provided. The lubricant pump is part of a lubrication system 214. The lubrication system 214 lubricates certain portions of the engine 36, such as, for example but without limitation, the pivotal joints of the connecting rod 58 with the crankshaft 56 and with the pistons 48, the cam shaft 124, 126, the bearings journaling the crankshaft 56 within the crankcase and the walls of the cylinder bores 46. The lubricant pump 212 draws lubricant from a lubricant reservoir 216. The lubricant from the reservoir 134 is provided to the engine 24 for lubrication through a supply line 218. Preferably, a variety of sensors are provided in a lubrication system to indicate an operational state of the lubrication system. For instance, in the illustrated arrangement, a pressure sensor 220 as well as a temperature sensor 222 are provided. These sensors 220, 222 provide signals to the ECU 110. After the lubricant has passed through the various engine galleries, the lubricant preferably is returned to the lubricant reservoir 216 through a return line 224. provided at a lower end of the crank case.

Preferably, the driveshaft 120 also powers a water pump 226. The water pump 226 draws cooling water from within the body of water in which the watercraft is operating and provides it to the engine 36 and various other components. In the illustrated arrangement, the coolant provided by the cooling pump 226 can be provided to a variety of cooling jackets 238. In this manner, the coolant can cool the engine 36 as well as various operating components related to the engine 36 and the watercraft 12 and can be returned to the body of water in which the watercraft 12 is operating. Of course, in some arrangements, a reservoir containing coolant can be provided from which the coolant is drawn and returned.

As noted above, the engine control system 11 controls various engine operations. The engine control system 11 includes the ECU 110, various sensors and actuators. As is well known in the art, to appropriately control the engine 36, the engine control system 11 preferably utilizes maps and/or indices stored within the memory of the ECU 110 with reference to the data collected from various sensors. For example, the engine control system 11 may refer to data collected from the throttle valve position sensor 108 and other sensors provided for sensing engine running conditions, ambient conditions or conditions of the outboard motor 10 that will affect engine performance.

It should be noted that the ECU 110 may be in the form of a hard wired feed back control circuit that perform the operations the described below. Alternatively, the ECU may be constructed of dedicated processor and a memory for storing a computer program configured to perform operations described below. Additionally, the ECU may a general purpose computer having a general purpose processor and the memory for storing a computer program for performing the operations described below.

Some of the more important sensors for the engine control system will be described below. An induction pressure sensor 230 is provided to detect the pressure within an induction system 60 associated with the engine 36. In some arrangements, the pressure sensor 230 may be provided to a single intake pipe 68 or may be provided in each intake pipe 68 individually. The ECU 110 preferably also receives a signal from an atmospheric pressure sensor 232. The atmospheric pressure sensor 232 communicates with the ECU 110 and provides a signal indicative of the pressure in the environment in which the watercraft is operating. An oxygen detection sensor 234 may be provided in the exhaust system 117 to indicate an operational status of the engine 36. The oxygen detection sensor 234 can be used to detect how complete combustion is within the combustion chamber 52 in any manner known to those of ordinary skill in the art. A coolant temperature sensor 236 outputs a signal indicative of a temperature of coolant flowing through a cooling jacket 228 associated with the cylinder block 40. Of course, this sensor 236 can be positioned in other positions such that it outputs a signal indicative of an operating temperature of the engine 36 to the ECU 110. A suitable speed sensor 238 preferably is provided to sense the engine speed, as indicated by the rotational speed of the crankshaft 56. In the illustrated arrangement, a pulsar coil 240 is connected to the crankshaft 56 and the speed sensor 238 operates to detect the rotational speed of the pulsar coil 240. The signals generated by the speed sensor 238 are then transmitted to the ECU 110 for use in manners which will be described. An outboard motor position sensor 242 is connected to the outboard motor 10 and to the ECU to provide a signal to the ECU 110 which is indicative of a relative positioning of the outboard motor 10 and the watercraft 12. Of course, it should be appreciated that it is practicable to provide the outboard motor 10 with other sensors.

As mentioned above, the outboard motor 10 preferably also includes a main switch 244. The main switch 244 is connected to the ECU 110. The main switch 244 and the ECU 110 are configured such that when the main switch 244 is turned off, the ECU 110 stops emitting control signals to, for example, the fuel injectors 138 and the spark plugs 174. Accordingly, the main switch 244 can be used to turn off the engine 36. In a similar manner, when the main switch 244 is turned on the ECU 110 resumes emitting control signals.

With reference to FIGS. 4, 5, 6 and 7, the operation and control of the fuel injection system 136 will now be described in detail. In the preferred embodiment, the fuel injection system 136 is controlled by a fuel injection control system, which preferably is a subsystem of the engine control system 11. Accordingly, the fuel control system shares several components with the engine control system, such as, for example, the ECU 110 and the speed sensor 238. However, it should be appreciated that the fuel control system could include separate components or be entirely separate from the engine control system 11. Preferably, the fuel system is a subsystem of the engine because this arrangement reduces number of parts and the cost of the outboard motor 10.

As mentioned above, the fuel control system preferably includes a controller such as the ECU 110 that can receive data, perform steps and send commands. The fuel control system also includes several sensors, such as, the speed sensor 238. The fuel control system further includes actuators, such as the solenoids for opening and closing the fuel injectors 138.

The fuel control system preferably controls the timing and opening duration of the fuel injectors 138. The duration for which the nozzles of the fuel injectors 136 are opened per unit time is referred to as the duty ratio. During normal engine operations, the fuel control system determines the duty ratio in response to various engine running conditions. That is, to determine the desired duty ratio, the fuel control system compares data collected from various sensors to maps and/or indices stored within the memory of the ECU 110. For example, the duty ratio can be adjusted in response to the engine speed or throttle position. The engine speed and throttle position are determined by the signals sent by the speed sensor 238 and the throttle position sensor 108, respectively. The duty ratio also may be adjusted in response to the intake air pressure and/or temperature. Such methods for controlling the duty ratio during normal engine operation are well known to those of ordinary skill in the art and a further discussion is not necessary.

A problem with prior fuel control systems is that, when the engine is being started, the engine speed cannot be determined until the engine completes one or more revolutions. Because fuel typically is injected in response to a measured engine speed, the fuel is not immediately delivered to the combustion chambers. This prevents the engine from starting immediately and requires the starter device (e.g., the starter motor or recoil starter) to turn the engine 36 longer. Moreover, the fuel system 136 typically requires some preparation time before fuel can be injected into the combustion chambers 52. Accordingly, when the engine is being started, fuel injection does not occur simultaneously with the start of crankshaft rotation. This can result in a rough start.

Figure 7:
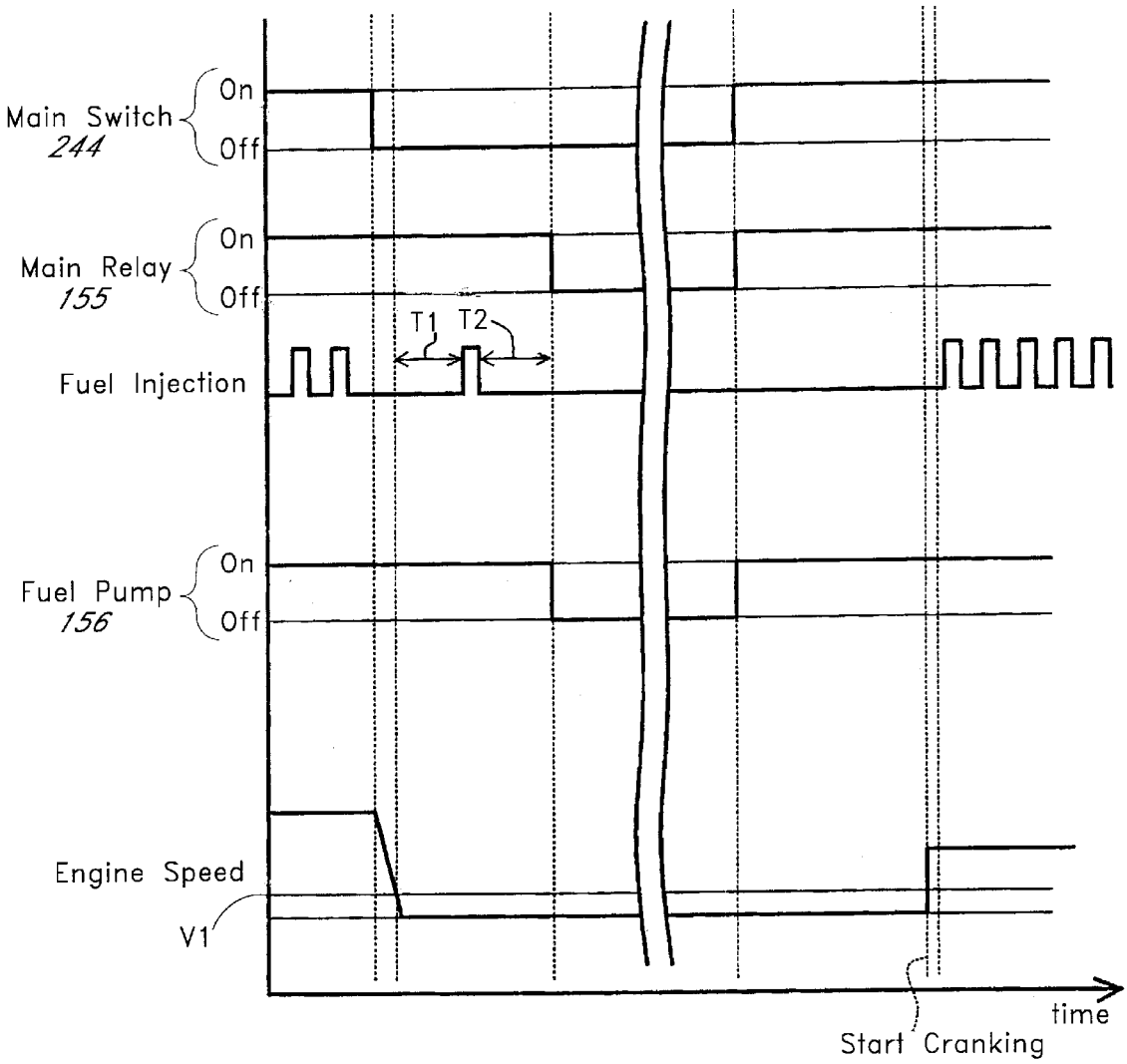
FIG. 7 is a graphical illustration of the operational states of a main switch, a main relay, at least one fuel injector, a fuel pump and the engine speed over time when the outboard motor is operated according to certain features and aspects of the present invention.

With reference now to FIG. 7, a graphical depiction of a control arrangement having certain features aspects and advantages of the present invention is illustrated therein. This arrangement enables the engine to start more quickly and smoothly. As shown in FIG. 7, when the main switch 244 is turned off, the ECU 110 stops outputting to control signals to, for example, the fuel injectors 138 and the spark plugs 174. This results in a decrease of engine speed. In contrast, the main relay 155 and the fuel pump 156 preferably remain on to maintain pressure in the fuel supply system.

When the engine speed falls below a preset speed or becomes substantially zero (i.e., below a specified value V1, which is preferably less than about 100 RPM), the fuel injection control system waits a preset time period T1 (preferably about 3 seconds) and injects an amount of fuel N once through the injectors 138 and into the induction system 60. Preferably, the first preset time period T1 is set such that rotation of the crankshaft has stopped. With reference to FIG. 5, waiting the time period T1 allows the injected fuel N to remain inside the intake ports 63 or intake pipes 62. Because the intake pipes 62 preferably incline uphill toward the combustion chamber 52 or extend almost horizontally toward the combustion chamber (see FIG. 2), the injected fuel N tends to flow towards the combustion chambers 52 and away from the upstream side in the intake pipes 62.

After the fuel is injected into the induction system 60, the injection control system preferably waits a second preset time period T2 (preferably about 3 seconds) before turning off the main relay 155 and the fuel pump 156. The second time period T2 allows the fuel supply system to repressurize after the injection of fuel.

With continued reference to FIG. 7, when starting the engine 36, the main switch 244 and the main relay 155 are turned on and the fuel pump 156 starts working. Next, the crankshaft 56 is rotated by a starter motor or a recoil starter. As the crankshaft 56 turns, the injected fuel N that remains in the intake pipes 62 is drawn into the combustion chamber 52 and is ignited by the spark plug 174. After ignition, normal fuel injection from the fuel injectors 128 can begin. Accordingly, the present invention facilitates a quick engine start, which is somewhat similar to an engine with a carburetor.

Figure 8:
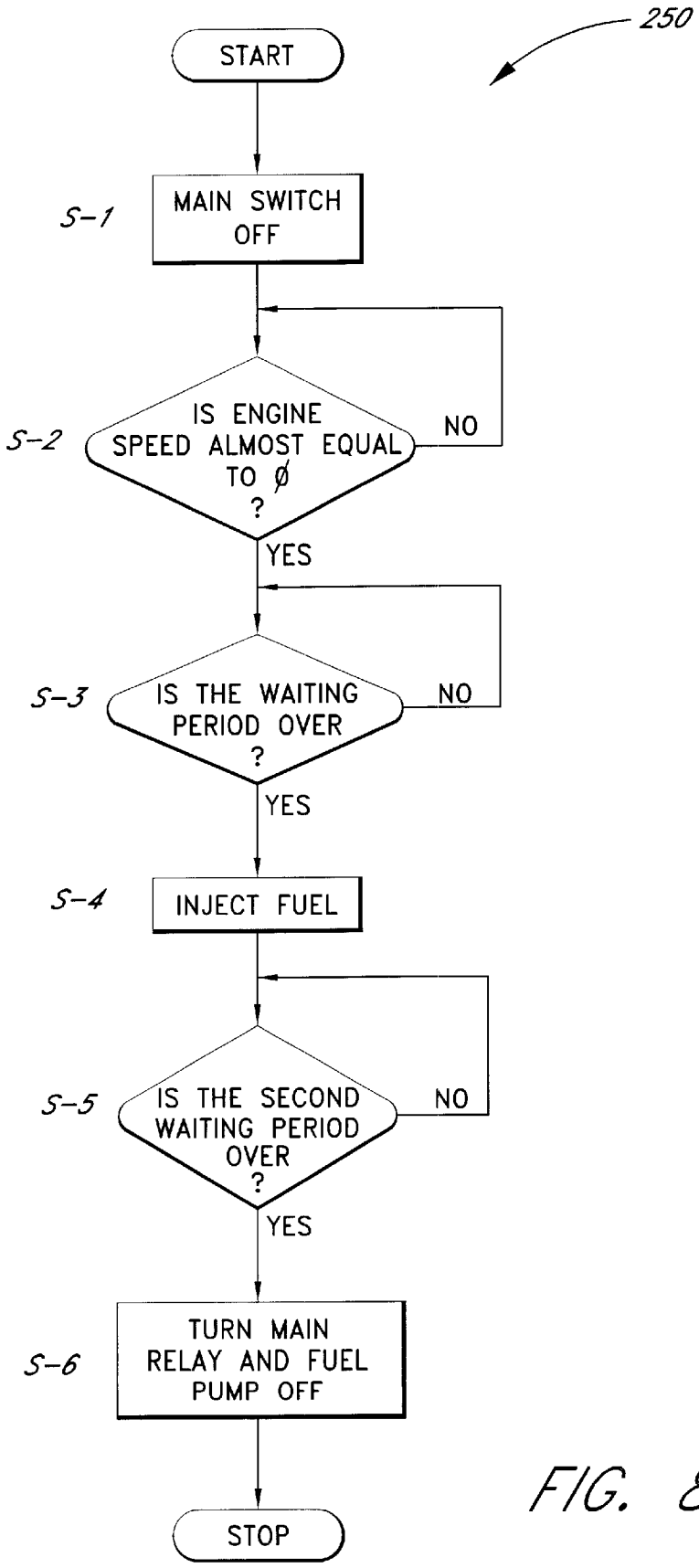
FIG. 8 is flow diagram illustrating a control routine having certain features and advantages according to the present invention.

With reference now to FIG. 8, a control routine 250 that is capable of implementing a fuel injection control strategy that can achieve control similar to that described graphically in FIG. 7 is illustrated therein. This control routine 250 preferably is executed by the ECU 110. As shown in FIG. 8 and represented by operational block S1, the routine 250 begins when the main switch 244 is turned off (see S-1) After the main switch 244 is turned off, the routine 250 determines if the engine speed is almost zero (see S-2). It should be noted that an engine speed that is below an engine speed capable of maintaining engine operation can be used as an engine speed that indicates the engine speed is substantially zero. Preferably, this involves determining if the engine speed, as measure by the engine speed sensor 238, is below a specified value V1, such as, for example, 100 RPM. If the engine speed is greater than the specified value V1, then the routine 250 begins again by continuing to determine if the if the engine speed is almost zero. However, if the engine speed is less than the specified value V1, then the routine begins a waiting period as represented by decisional block S-3. Preferably, the waiting period is about 3 seconds. When the waiting period is over, fuel is injected into the induction system 60 as indicated by operational block S-4. Preferably, the fuel is injected through the fuel injectors 138 only once and the fuel remains in the intake ports 63 as shown in FIG. 5. If the waiting period is not over, the routine 250 loops back until it is time to inject fuel into the induction system 60.

After fuel injection has stopped, the routine 250 preferably begins a second waiting period as represented by decisional block S-4. As mentioned above, the purpose of the second waiting period is to allow the fuel pressure in the fuel system 126 to increase. Preferably, the second waiting period is about 3 seconds. When the second waiting period is over, the main relay 155 and the fuel pump 155 are turned off as indicated by operational block S-5. If the waiting period is not over, the routine 250 loops back until it is time to turn off the main relay 155 and the fuel pump 155.

It should be noted that there are several proxies for engine speed that can be used instead of the engine speed sensor 238 described above. For example, the output from the AC generator can be monitored and used as a proxy for engine speed. That is, if the engine speed is below a certain level, then the generator typically stops generating electricity. The ECU 110 can be configured such that if the generator stop generating electricity the first waiting period begins. Other proxies for engine speed might include, for example, without limitation, the rotation of the camshaft or the intake air pressure.

As mentioned above, this fuel control system advantageously allows the engine to start more quickly and more smoothly under both manual and automatic start conditions. For example, under manual start conditions, the engine 36 begins rotating when the operator pulls on the recoil starter. The fuel that was injected into the induction system 60 after the first waiting period is drawn in to the combustion chamber 52 and ignited by the spark plugs 174. Accordingly, the engine 36 starts more smoothly and quickly as compared to prior art engines. In a similar manner, under automatic start conditions, the engine 36 begins rotating when the starter motor is turned on. The fuel remaining in the induction system 60 is drawn into the combustion chamber 52 and ignited by the spark plugs 174. Again. this enables the engine 26 to start more smooth and quickly.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Moreover, many of the steps of the routines described above can be performed in various orders, as will be well understood by one skilled in the art from the above description, while still carrying out one or more objects or advantages of the present invention. Thus, it is intended that the scope of the present invention herein disclosed should not be limited by the particular disclosed embodiments described above, but should be determined only by a fair reading of the claims that follow.

What is claimed is:

1. An internal combustion engine comprising at least one combustion chamber formed by at least a first member and a second member that moves relative to the first member, the second member being coupled to an output shaft such that movement of the second member causes the output shaft to rotate, a fuel injection system including a fuel injector that supplies fuel to the combustion chamber and a fuel pump that supplies fuel to the fuel injector, the fuel injector including an actuator to regulate an amount of fuel injected by the fuel injector, a main switch having an on position and an off position, and a fuel control system including a controller, which is operatively connected to the actuator, and a sensor, which is arranged to detect rotation of the output shaft, the sensor being adapted to produce a signal that is indicative of rotation of the output shaft and being operatively connected to the controller, the controller being configured such that, when the engine is operating and the main switch is turned from the on position to the off position, the controller outputs a control signal to the actuator so that fuel is no longer injected through the fuel injector and after a specified time the controller outputs a control signal to the actuator to inject a second amount of fuel when the sensor indicates that the output shaft is rotating below a specified speed.

2. The engine as set forth in claim 1 additionally comprising an air induction system that delivers an air charge to the combustion chamber and wherein the fuel injector is arranged to spray the fuel into the air induction system.

3. The engine as set forth in claim 2, wherein the air induction system includes an intake pipe that communicates with the combustion chamber, the intake pipe extending from the combustion chamber in a direction that lies in the direction consisting of the group of a generally horizontal direction or a generally upwardly inclined direction with respect to the generally horizontal direction.

4. The engine as set forth in claim 3, wherein air induction system further includes a throttle valve disposed in the intake pipe and the fuel injector is arranged to spray fuel into the intake pipe downstream of the throttle valve.

5. The engine as set forth in claim 1, wherein the specified time is approximately three seconds.

6. The engine as set forth in claim 1, wherein after the second amount of fuel is injected, the controller is further configured to shut off the fuel pump after a second specified time.

7. The engine as set forth in claim 1, wherein the second specified time period is approximately three seconds.

8. The engine as set forth in claim 1, wherein the specified speed is approximately 100 RPM.

9. The engine as set forth in claim 1 in combination with a marine propulsion device, wherein the engine powers the marine propulsion device.

10. The engine as set forth in claim 9, wherein the marine propulsion device is an outboard motor and the engine is enclosed in a cowling of the outboard motor.

11. A method of stopping an internal combustion engine including a combustion chamber, a crankshaft, a main switch, a fuel pump, and a fuel injector, the method comprising turning the main switch off, ceasing fuel injection through the fuel injector, sensing a rotational speed of the crankshaft, determining if the rotational speed of the crankshaft is below a specified value, waiting a specified time, and injecting an amount of fuel through the fuel injector after the specified time if the rotational speed of the crank shaft is below a specified value.

12. The method as set forth in claim 11, wherein the specified time is approximately three seconds.

13. The method as set forth in claim 11, wherein the specified value is approximately 100 RPM.

14. The method as set forth in claim 11, further comprising waiting a second specified time and shutting off the fuel pump after the second specified time.

15. The method as set forth in claim 14, wherein the second specified time is approximately three seconds.

* * * * *